United States Patent [19]

Wolfram

[11] Patent Number: 4,625,598

[45] Date of Patent: Dec. 2, 1986

[54] POSITIVE ENGAGEMENT SCREW DRIVER TOOL

[76] Inventor: Frank Wolfram, 375 Alta Dr., Grayslake, Ill. 60030

[21] Appl. No.: 732,688

[22] Filed: May 10, 1985

[51] Int. Cl.[4] ..... B25B 13/48

[52] U.S. Cl. ..... 81/436; 81/441

[58] Field of Search ..... 81/436, 441

[56] References Cited

U.S. PATENT DOCUMENTS

| | | | |
|---|---|---|---|
| 370,255 | 9/1887 | Hart . | |
| 697,836 | 4/1902 | Gorham . | |
| 810,340 | 1/1906 | Meis | 81/436 |
| 1,479,506 | 1/1924 | Kellemen | 81/436 |
| 1,797,390 | 3/1931 | Wood . | |
| 2,676,510 | 4/1954 | Hodell . | |
| 2,684,094 | 7/1954 | Lissy . | |
| 2,804,894 | 9/1957 | Rosenburg . | |
| 2,808,087 | 10/1957 | Vaughn . | |
| 2,936,010 | 5/1960 | Ansingh . | |
| 2,994,354 | 8/1961 | Vaughn . | |
| 3,026,920 | 3/1962 | York . | |
| 3,120,251 | 2/1964 | York . | |
| 3,236,275 | 2/1966 | Smith . | |
| 3,897,812 | 8/1975 | Arnn . | |
| 3,923,088 | 12/1975 | Arnn . | |
| 4,105,056 | 8/1978 | Arnn . | |

FOREIGN PATENT DOCUMENTS

| | | | |
|---|---|---|---|
| 0136854 | 4/1985 | European Pat. Off. | 81/436 |
| 10612 | 8/1880 | Fed. Rep. of Germany | 81/436 |
| 1156718 | 10/1963 | Fed. Rep. of Germany | 81/436 |

*Primary Examiner*—Frederick R. Schmidt
*Assistant Examiner*—Joseph T. Zatarga
*Attorney, Agent, or Firm*—John R. Garrett

[57] ABSTRACT

A screwdriver tool provides positive engagement with screw having a head with a straight slot. An end portion is substantially flat, but is wider at its midpoint than at its ends. A tapering segment extends from the end portion and an engagement area is defined on the side of the segment. Engagement initially occurs at a location intermediate to the ends and midpoint of the end portion. As torque on the screwdriver is increased the engagement extends toward the midpoint and up the side of the segment.

3 Claims, 11 Drawing Figures

POSITIVE ENGAGEMENT SCREW DRIVER TOOL

BACKGROUND OF THE INVENTION

This invention relates in general to tools for use with fastening devices and, in particular, to a tool which mates in positive engagement with the fastening device.

Prior art tools for use with screws having a head with a straight slot have an end which generally mates with the screw. The ends of these tools or screwdrivers, as they are commonly known, are tapered so that they easily fit into the slot or other recessed configuration in the screw head. A problem with these screwdrivers is that if the screw is very tight in some object, it may require a high degree of torque to remove the screw. Very often the head of the screw is damaged if the screwdriver slips when attempting to remove the screw. This can easily occur because the end of the screwdriver is not designed to fit perfectly into the recess or slot in the head of the screw.

The presentation invention overcomes this problem in the prior art.

SUMMARY OF THE INVENTION

The present invention is a screwdriver tool which provides positive engagement with screws having a head with a straight slot. An end portion is substantially flat, but is wider at its midpoint than at its ends. A tapering segment extends from the end portion and an engagement area is defined on the side of the segment. Engagement initially occurs at a location intermediate to the ends and midpoint of the end portion. As torque on the screwdriver is increased the engagement extends toward the midpoint and up the side of the segment.

OBJECTS OF THE INVENTION

It is the primary object of the present invention to provide an improved tool capable of positive engagement with a fastening device.

It is a secondary object of the present invention to provide an improved tool which prevents damage to the fastening device.

BRIEF DESCRIPTION OF THE DRAWINGS

The features of the present invention which are believed to be novel are set forth with particularity in the appended claims. The invention together with further objects and advantages may best be understood by reference to the following description taken in conjunction with the accompanying drawings, in the several figures of which like reference numerals identify like elements, and in which:

DESCRIPTION OF THE PREFERRED EMBODIMENT

Figure 1:
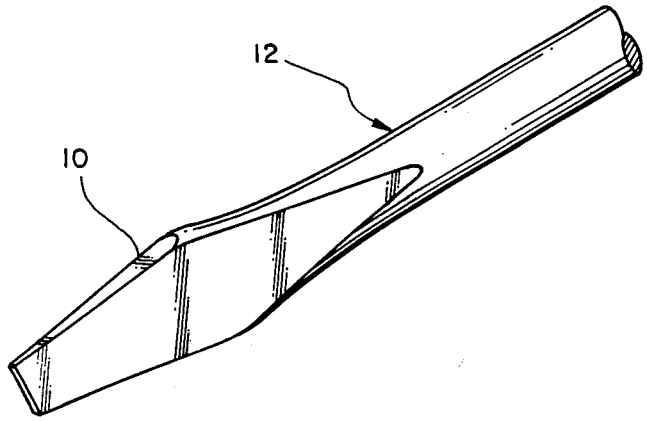
Fig. 1 PRIOR ART
FIG. 1 is a partial perspective view of a prior art screwdriver.
Figure 4:
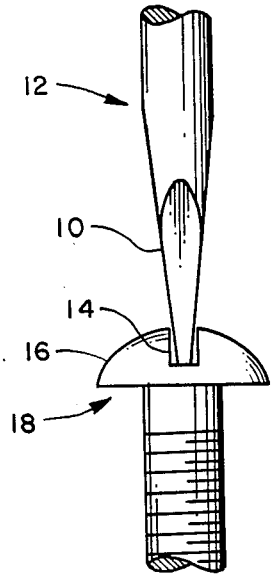
PRIOR ART Fig. 4
FIG. 4 is a side view illustrating the engagement of a prior art screwdriver with a screw.

The present invention provides a solution to a problem in the prior art which has existed for a long time. When a prior art screwdriver, such as the one shown in FIG. 1, is used with a screw of the type shown in FIG. 2, there is a possibility that the screwdriver may slip and damage the head of the screw. This occurs because the end 10 of the prior art screwdriver 12 is tapered and does not fit perfectly in the slot 14 in the head 16 of the screw 18. The engagement of the screwdriver 12 and the screw 18 is illustrated in FIG. 4.

Figure 6:
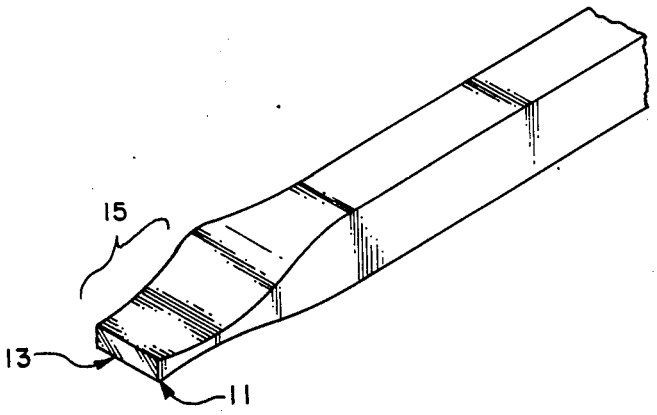
PRIOR ART Fig. 6
FIG. 6 is a partial perspective view of another type of prior art screw driver.
Figure 7:
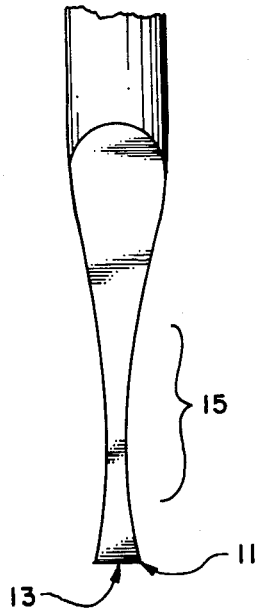
PRIOR ART Fig. 7
FIG. 7 is a side view of the FIG. 6 prior art screwdriver.

Another type of prior art screwdriver is shown in FIGS. 6 and 7. This screwdriver has an end 11 which has a flat surface 13. Extending from the end 11 is a tapering section 15. Although slippage is reduced, this type may still damage the screw since it only contacts the screw at the bottom of the slot.

Figure 2:
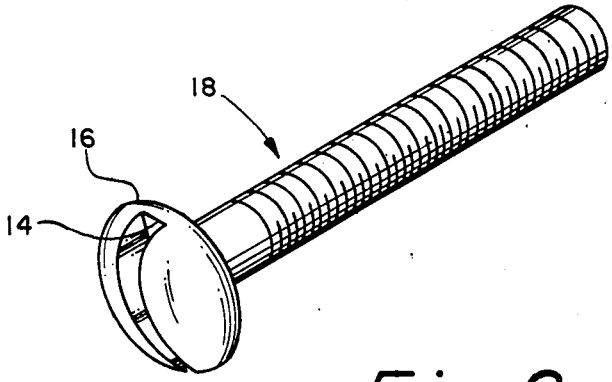
FIG. 2 is a partial perspective view of an embodiment of the present invention.

In general terms the present invention is a tool for use with a fastening device having at least a first end with a predetermined configuration, such as the screw 18 in FIG. 2. The novel tool comprises a body 20 (see FIG. 3) which may consist of a shaft of any suitable cross-sectional configuration that may terminate in a handle (not shown). The present invention concerns the means 22 for engaging the predetermined configuration in the first end of the fastening device. The means 22 is attached to the body 20. In the FIG. 2 fastening device the predetermined configuration is a recess or slot 14, the first end is head 16 and the fastening device is screw 18. The means 22 for engaging of the novel tool has a first portion on surface 24 for contacting substantially the bottom of the slot 14.

Figure 3:
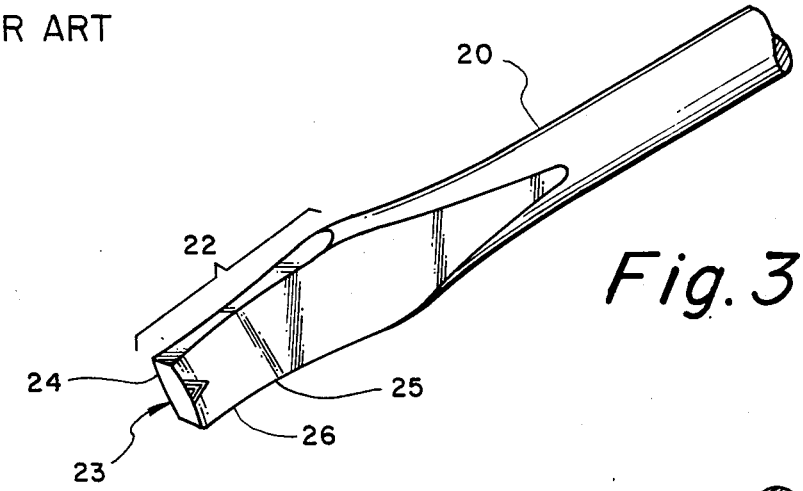
FIG. 3 is a partial perspective view of a type of fastening device or screw.
Figure 5:
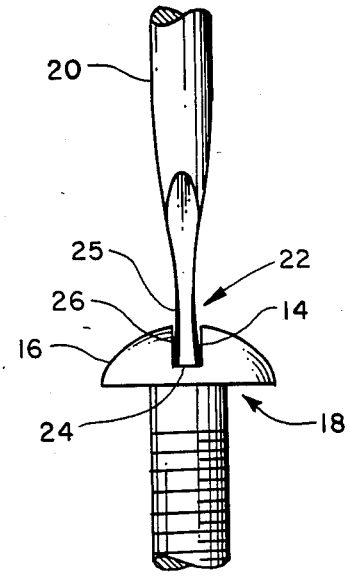
FIG. 5 is a side view illustrating the engagement of the novel tool of the present invention with a screw.

As is well known in the art, screws such as that shown in FIG. 2 have several standardized widths for the slot 14, the width depending upon the size of the screw 18. The surface 24, at a midpoint 23, as shown in FIGS. 3 and 5, has a width substantially equal to the width of the slot 14. A connection segment 26 tapers and extends from the flat surface 24 and has a width less than the width of the flat surface 14 at a point 25 which is a predetermined distance from the flat surface 24. The tapering of the connecting segment 26 facilitates the engagement of the flat surface 24 with the bottom of the slot 14.

Figure 8:
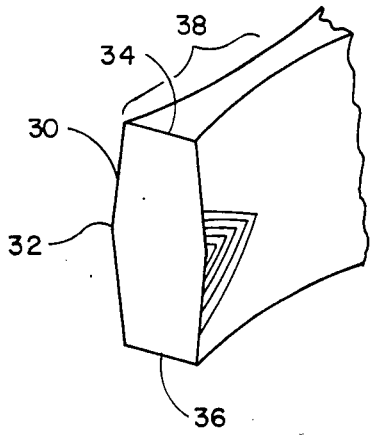
FIG. 8 is a partial perspective view of an embodiment of the present invention.
Figure 9:
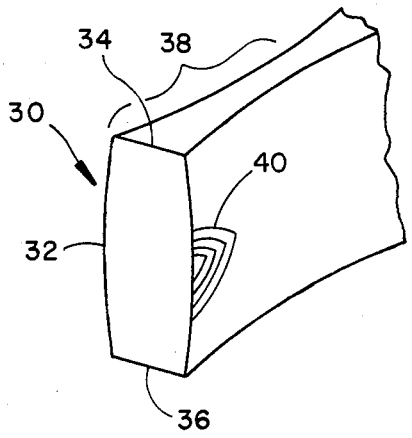
FIG. 9 is a partial perspective view of another embodiment of the present invention.
Figure 10:
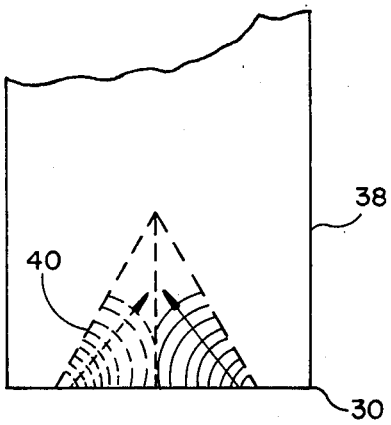
FIG. 10 is a side view of the present invention illustrating the area of engagement.

As shown in greater detail in FIGS. 8–11, a first end 30 is wider at its midpoint 32 than at either end 34, 36. The edge connecting the midpoint 32 to the ends 34, 36 may be straight, as shown in FIG. 8 or smoothly curved as shown in FIG. 9. Due to the taper of section 38 which extends from the first end 30, an engagement area 40 is defined and is shown as the shaded triangular area in FIGS. 8 and 9. FIG. 10 depicts a side view of section 38 also showing the engagement area 40.

Figure 11:
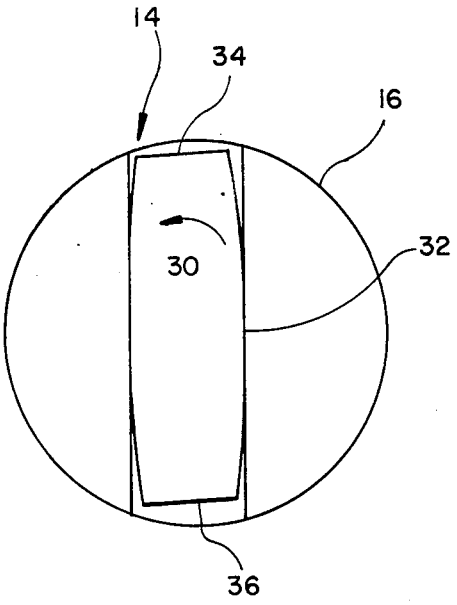
FIG. 11 is a top view of the present invention illustrating the area of engagement.

FIG. 11 illustrates in a top view engagement of the novel screwdriver with the slot 14 in the head 16 of a screw. The width of the first end 30 at the midpoint 32 substantially fits the width of the slot 14. As the screwdriver is turned, torque is applied to the sides of the slot 14 along the engagement area 40 of the section 38 as shown in FIG. 10. Surprisingly, the engagement does not begin at the midpoint 32, but rather a distance away from the midpoint 32 and increases towards the midpoint 32 and up section 38 as the torque is increased. As a result a more positive engagement occurs between the slot 14 and the screwdriver. This result occurs for both embodiments shown in FIGS. 8 and 9. Preferably the midpoint is on each side of end 30 is 0.003 inches to 0.005 inches wider than the ends 34, 36. The overall size of the end 30 would be manufactured in different sizes as is well known in the art to fit different size standard screws.

The invention is not limited to the particular details of the apparatus depicted and other modifications and applications are contemplated. Certain other changes, such as the configuration of the means for engaging, may be made in the above-described apparatus without departing from the true spirit and scope of the invention herein involved. It is intended, therefore, that the subject matter in the above depiction shall be interpreted as illustrative and not in a limiting sense.

What is claimed is:

1. A tool for use with a fastening device having a head with a straight slot of predetermined width comprising:

a body;

a segment having a top end attached to said body and a bottom end, said segment tapering to a thickness less than a thickness of said bottom end between said top and bottom ends;

an end portion atteched to said bottom end of said segment having a midpoint which is wider than the width of its ends, said end portion having substantially arched line segments connecting said midpoint to said ends of said end portion; and an engagement area between at least a side of said segment and a side of the slot in the head of the fastening device which initially occurs at approximately a point intermediate to said midpoint and said end of said end portion on said arched line segment and increases in area toward said midpoint and toward said top end of said segment as increasing torque is applied to the tool;

wherein said engagement area increases with increasing torque due to deformation of the material which forms the fastening device.

2. A tool described in claim 1 wherein said engagement area is substantially triangular in shape.

3. The tool described in claim 1 wherein said end portion is substantially a flat surface.

* * * * *